United States Patent [19]

McNeil

[11] Patent Number: 4,529,425

[45] Date of Patent: Jul. 16, 1985

[54] PLANT FOR PRODUCING GASEOUS OXYGEN

[75] Inventor: Brian A. McNeil, Chessington, England

[73] Assignee: Air Products and Chemicals, Inc., Allentown, Pa.

[21] Appl. No.: 516,840

[22] Filed: Jul. 25, 1983

[30] Foreign Application Priority Data

Aug. 24, 1982 [GB] United Kingdom ..... 8224276

[51] Int. Cl.[3] ..... F25J 3/04

[52] U.S. Cl. ..... 62/37; 62/39

[58] Field of Search ..... 62/21, 37, 38, 39, 23, 62/24, 27, 28, 29, 30, 31, 34

[56] References Cited

U.S. PATENT DOCUMENTS 3,605,422 9/1971 Pryor et al. ..... 62/37

*Primary Examiner*—Frank Sever

*Attorney, Agent, or Firm*—James C. Simmons; E. Eugene Innis

[57] ABSTRACT

A plant for producing gaseous oxygen which plant comprises a heat exchanger (6) for cooling feed air, a double distillation column (7) having a high pressure column (8) for receiving at least part of said feed air, and a low pressure column (15), a liquid oxygen storage vessel (19) communicating with said low pressure column (15) and a liquid storage vessel (37) communicating with said high pressure column (8), characterized in that said plant further comprises an expander (27) arranged to expand vapor from said high pressure column (8) and pass the expanded vapor through said heat exchanger (6) and further characterized in that said plant comprises means to control the flow of vapor through said expander (27).

4 Claims, 2 Drawing Figures

PLANT FOR PRODUCING GASEOUS OXYGEN

Figure 1:
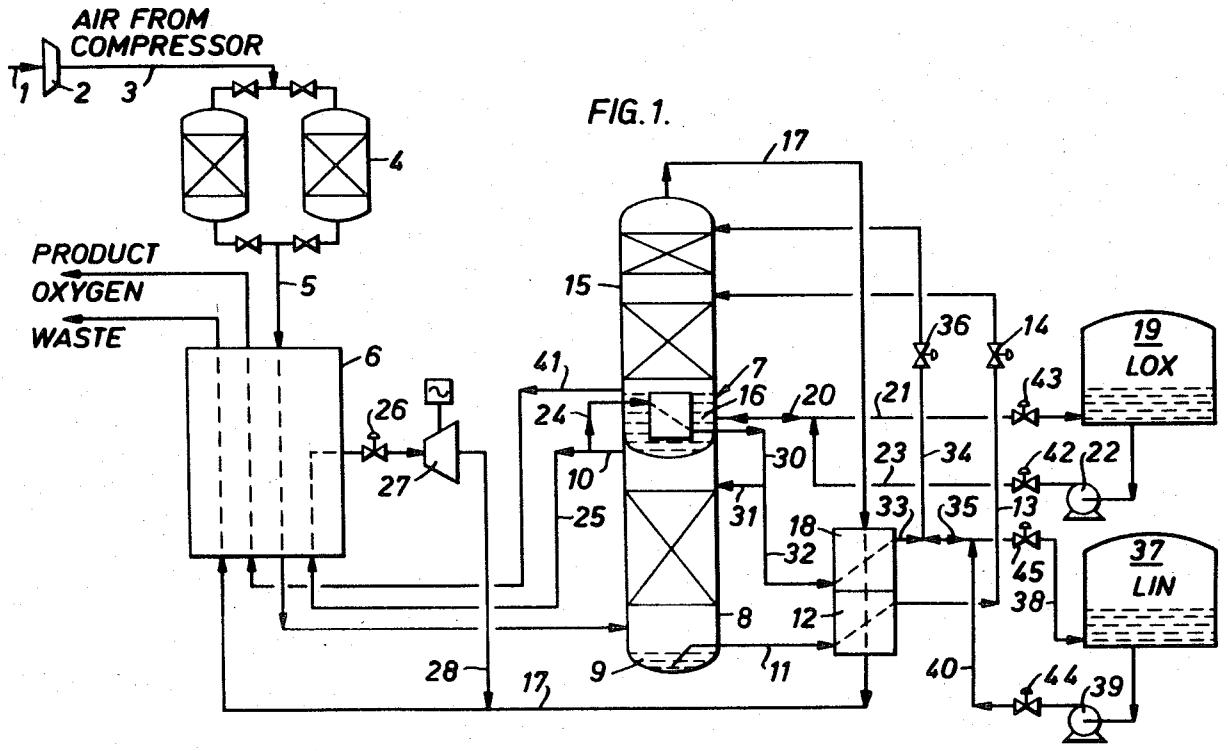

This invention relates to a plant for producing gaseous oxygen.

In conventional air separation plant it is possible to reduce the production rate by as much as 50%. However, such changes cannot be effected rapidly—typically taking about an hour (under computer control) if product quality is to be maintained.

For certain technical applications it is desirable to have available a supply of gaseous oxygen which can be greatly increased or reduced for short periods. Indeed for certain applications it is desirable to be able to vary the production rate by as much as 300%.

In order to meet this problem cryogenic engineers developed, in the late fifties, the Wechsel Speicher Process. The principle behind this process is that during periods of low oxygen demand the plant produces liquid oxygen which is sent to storage. In times of high oxygen demand the normal gaseous oxygen supply is supplemented by evaporating liquid oxygen. The refrigeration balance on the plant is maintained by producing liquid nitrogen whilst liquid oxygen is being evaporated and evaporating liquid nitrogen whilst liquid oxygen is being produced.

One of the difficulties associated with prior art plants is that the production rate of gaseous oxygen cannot be varied rapidly without upsetting the operating conditions in the distillation columns. For this reason it has therefore been extremely difficult to associate an argon recovery column with a plant of this type. It has also been extremely difficult to vary the production rate of gaseous oxygen rapidly without some loss of product quality.

Typical of the prior art is UK Pat. No. 1,528,428 from which it can be deduced that the product quality varies according to demand, a factor which is of little consequence in such applications as oxygen injection into waste water.

According to the present invention there is provided a plant for producing gaseous oxygen which plant comprises a heat exchanger for cooling feed air, a double distillation column having a high pressure column for receiving at least part of said feed air, and a low pressure column, a liquid oxygen (LOX) storage vessel communicating with said low pressure column, means to bring liquid oxygen from said LOX storage vessel into heat exchange with vapour from said high pressure column to provide reflux for said high pressure column, and a liquid storage vessel communicating with said high pressure column, and means to return liquid from said liquid storage vessel to said column as reflux, characterised in that said plant further comprises an expander arranged to expand vapour from said high pressure column and pass the expanded vapour through said heat exchanger and further characterised in that said plant comprises means to control the flow of vapour through said expander.

Preferably, the expander is arranged to expand nitrogen from the top of said high pressure column.

Advantageously, the liquid storage vessel is arranged to receive liquid nitrogen.

Figure 2:
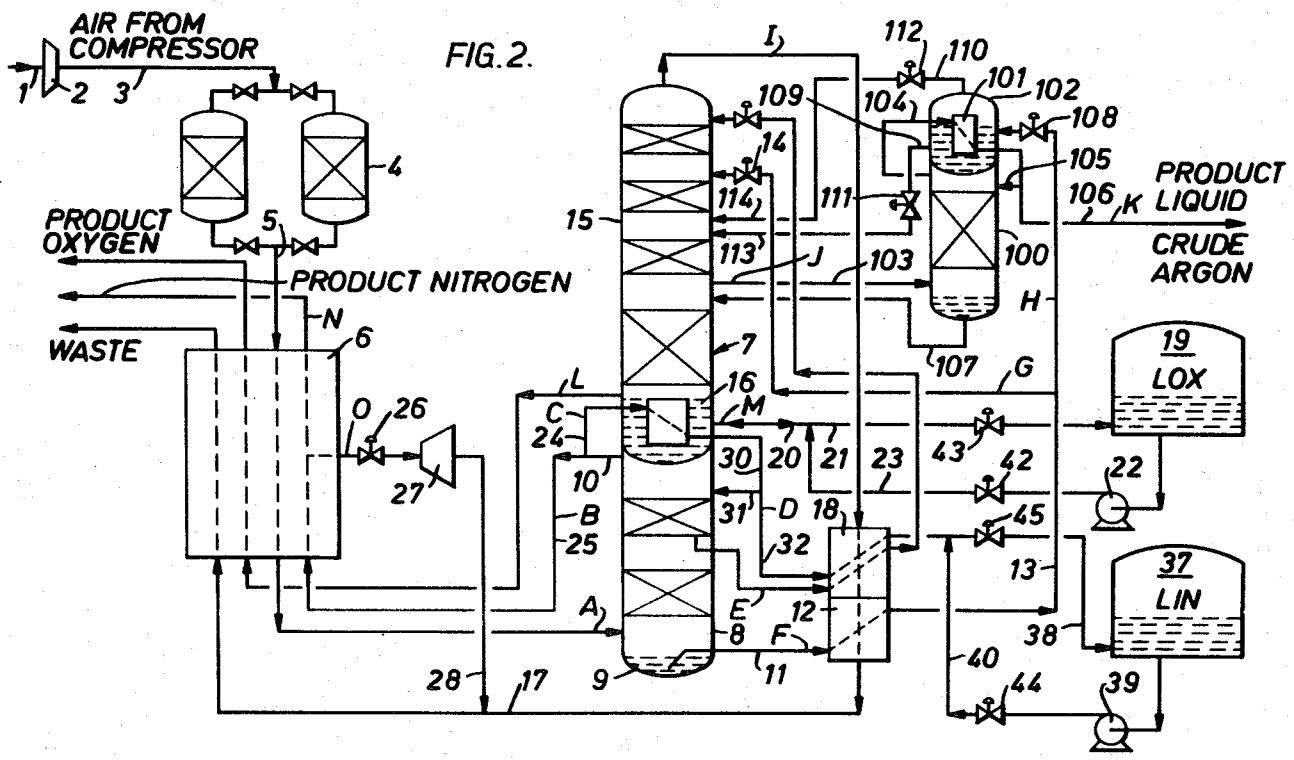

For a better understanding of the present invention and to show how the same may be carried into effect, reference will now be made, by way of example, to the accompanying drawings in which:

FIG. 1 is a simplified flow sheet of one embodiment of a plant in accordance with the invention; and FIG. 2 is a simplified flow sheet of a second embodiment of a plant in accordance with the invention.

Referring to FIG. 1, feed air 1 is compressed by compressor 2 and passed through line 3 to one of a pair of molecules sieves 4 where water vapour and carbon dioxide are adsorbed.

The dry, carbon dioxide free air passes through line 5 and is cooled in heat exchanger 6 before entering the high pressure column 8 of a double distillation column generally identified by reference level 7. The high pressure column 8 separates the dry, carbon dioxide free air into crude liquid oxygen (LOX) 9 and gaseous nitrogen which leaves the high pressure column 8 through conduct 10.

The crude LOX leaves the high pressure column through line 11 and is sub-cooled in heat exchanger 12. The sub-cooled crude LOX leaves heat exchanger 12 through line 13 and, after expansion at valve 14 is introduced into the low pressure column 15 of the double distillation column 7 where it is separated into liquid oxygen (LOX) 16 and a gaseous waste stream which leaves the low pressure column 15 through line 17. The gaseous waste stream is heated in heat exchanges 18, 12 and 6 before being vented to atmosphere.

A liquid oxygen storage tank 19 is connected to the bottom of the low pressure column 15 via a reversible line 20 and a storage line 21. The liquid oxygen storage tank 19 also communicates with the reversible line 20 via a pump 22 and a return line 23.

The gaseous nitrogen which leaves the high pressure column 8 through line 10 can be passed either through line 24 or through both lines 24 and 25. Line 25 passes through part of heat exchanger 6 and communicates with an expander 27. The outlet of expander 27 is connected to line 17 by line 28. A valve 26 is situated in line 25 upstream of the expander 27. Flow through the expander 27 can be varied by adjusting the inlet guide vanes on the expander 27 whilst valve 26 is primarily used to totally shut-off the flow through expander 27.

Line 24 is connected to reboiler/condenser 29 situated in the bottom of the low pressure column 15. Liquid nitrogen leaves the reboiler/condenser 29 through line 30 and part is returned through line 31 to high pressure column 8 as reflux whilst the balance is passed through line 32 to heat exchanger 18 where it is subcooled. The subcooled liquid nitrogen leaves heat exchanger 18 through line 33 which communicates with line 34 and reversible line 35. The line 34 communicates with the low pressure column 15 via an expansion valve 36.

A liquid nitrogen (LIN) storage tank 37 communicates with the reversible line 35 via a storage line 38 and via a pump 39 and return line 40.

Gaseous oxygen leaves the low pressure column 15 through line 41 and is used to cool dry, carbon dioxide free air in heat exchanger 6.

For the purposes of illustrating the operation of the embodiment shown in FIG. 1, a base case will be assumed wherein the LOX storage tank 19 and the LIN storage tank 37 are both half full of liquid oxygen and liquid nitrogen respectively. It will also be assumed that (i) product gaseous oxygen is being withdrawn, (ii) part of the gaseous nitrogen from the top of the high pressure column 8 is being expanded through expander 27, and (iii) no LOX or LIN is being withdrawn from or supplied to LOX storage tank 19 and LIN storage tank 37 except to compensate for evaporation.

In order to increase the production of gaseous oxygen to maximum output valve 26 is closed and the expander stopped, pump 22 is started valves 42 and 45 opened and valves 43 and 44 closed.

As valve 26 is closed the temperature of the air at the cold end of heat exchanger 6 will rise although the total molar flow of feed to the high pressure column 8 will remain constant. The additional nitrogen entering reboiler/condenser 29 is condensed by the evaporation of an additional quantity of liquid oxygen supplied from LOX storage tank 19 via line 23 and reversible line 20.

Whilst additional liquid nitrogen is produced in reboiler/condenser 29 the flow of liquid nitrogen through line 31 as reflux is maintained relatively constant so that the ratio (L/V) (moles of liquid travelling down the column/moles of gas travelling up the column) remains substantially constant. The additional liquid nitrogen is sub-cooled in heat exchanger 18 and passed through reversible line 35 into LIN storage tank 37. The volume of liquid nitrogen expanded through valve 36 remains relatively constant throughout. As the excess oxygen evaporated in the bottom of low pressure column 15 passes through line 41 the (L/V) of the low pressure column 15 also remains substantially constant throughout. As time passes the amount of liquid oxygen in the LOX storage vessel 19 will progressively decrease whilst the amount of liquid nitrogen in the LIN storage vessel 37 will progressively increase. However, the total amount of liquid in the two storage vessels combined will remain approximately constant.

Returning now to the base case it will be assumed that the plant is required to operate with minimum gaseous oxygen output.

In this condition valve 26 is opened fully and the expander flow is established at a substantially higher level than for the base case, pump 39 is started, valves 43 and 44 are opened and valves 42 and 45 closed. The expander 27 provides additional refrigeration for heat exchanger 6 to compensate for the loss of refrigeration during maximum GOX output and the gas enters the high pressure column 8 at a lower temperature than before. By increasing the gaseous nitrogen flow through line 25 the amount of gaseous nitrogen entering reboiler/condenser 29 decreases and hence the amount of liquid oxygen evaporated from the sump of the low pressure column 15 decreases. However, since the oxygen demand is at its minimum the total volume of vapour rising through the low pressure column 15 is approximately constant. The amount of liquid produced in the reboiler/condenser 29 is sufficient to provide the reflux for the high pressure column 8 and part of the reflux for the low pressure column 15. Additional, reflux for the low pressure column 15 is provided by the liquid nitrogen from LIN storage tank 37 supplied via line 40, reversible line 35 and line 34. Again the flow of liquid nitrogen through line 34 remains substantially constant so that the (L/V) of the low pressure column 15 remains substantially constant throughout the operation.

As the flow of gaseous nitrogen through the reboiler/condenser 29 is reduced the amount of liquid oxygen evaporated from the bottom of the low pressure column 15 decreases and the surplus liquid oxygen is passed through reversible line 20 and supply line 21 into the LOX storage tank 19. Thus, in this mode of operation the level of liquid oxygen in LOX storage tank 19 increases whilst the level of liquid nitrogen in LIN storage tank 37 decreases.

It will be appreciated that between the two extremes described are a variety of operating conditions which can be met simply by adjusting the flow through the expander 27 and controlling the flow of LOX and LIN to or from their respective storage tanks.

It will be noted that in the embodiment shown the expander 27 can be shut down completely. This is only possible with a plant which does not incorporate reversing heat exchangers for removing moisture and carbon dioxide from the air. Reversing heat exchangers could be used but, in such an embodiment, the expander 27 would have to be in continuous operation.

It should be appreciated that the above description has been somewhat simplified in so far as the temperature of the feed to the high pressure column 8 varies as the flow of gaseous nitrogen through the expander 27 varies. However, the change in temperature is relatively small so that any change in the (L/V) in the columns is small enough not to upset the process. The stability of the present process can be appreciated when it is considered that the plant will operate with an argon recovery column as hereinafter described with reference to FIG. 2.

Referring to FIG. 2, each of the parts corresponding to a part shown in FIG. 1 is identified by the same reference numeral as shown in FIG. 1. In addition to these parts, the plant comprises an argon recovery column 100 provided with a reflux condenser 101 situated in an evaporator 102. Feed for the argon recovery column 100 is passed from the low pressure column 15 through line 103. Crude gaseous argon leaves the top of the argon recovery column 100 through line 104 and is condensed in reflux condenser 101. Part of the liquefied crude argon is returned to the argon recovery column 100 through line 105 as reflux whilst the balance is passed through line 106 for further purification. Liquid rich in oxygen is returned from the base of argon recovery column 100 to the low pressure column 15 via line 107. The crude gaseous argon is condensed in reflux condenser 101 by heat exchange with part of the crude LOX from the bottom of the high pressure column which is expanded through valve 108 and introduced into evaporator 102. Liquid and vapour from evaporator 102 are passed through lines 109 and 110 respectively and, after expansion through valves 111 and 112 respectively, are introduced into the low pressure column 15 through line 113 and 114 as shown.

It is well known that the separation of crude argon from a mixture of oxygen, nitrogen and argon requires extremely stable conditions and it is a reflection of the stability of the present plant that such separation can be achieved.

In order to give a fuller understanding of the operation of the plant Table 1 sets out flow and pressure conditions at points A to O marked on FIG. 2 during minimum gaseous oxygen (GOX) output, average GOX output, and maximum GOX output.

TABLE 1

| Mass Balance | | |
|---|---|---|
| Basis | | |
| Constant air flow | = | 100 $Nm^3/hr$ |
| Oxygen purity | = | 99.6% $O_2$ |
| Oxygen delivery pressure | = | 1.03 bar abs |
| Nitrogen purity | = | 2 ppm $N_2$ |
| Nitrogen delivery pressure | = | 5 bar abs |
| Crude Argon purity | = | 95% Ar |

TABLE 1-continued

| Mass Balance | | | | | | |
|---|---|---|---|---|---|---|
| Operating Case Point | Maximum GOX | | Average GOX | | Minimum GOX | |
| | Flow ($Nm^3$/hr) | Pressure (bar a) | Flow ($Nm^3$/hr) | Pressure (bar a) | Flow $Nm^3$/hr) | Pressure (bar a) |
| A | 100 | 5.6 | 100 | 5.5 | 100 | 5.5 |
| B | 5.6 | 5.4 | 17.3 | 5.4 | 29.7 | 5.3 |
| C | 101.0 | 5.4 | 86.8 | 5.4 | 72.5 | 5.3 |
| D | 10.3 | 5.4 | 0.1 | 5.4 | −10.1 | 5.3 |
| E | 31.8 | 5.5 | 29.0 | 5.4 | 26.3 | 5.4 |
| F | 52.3 | 5.6 | 53.6 | 5.5 | 54.1 | 5.5 |
| G | 19.6 | 5.6 | 20.6 | 5.5 | 23.5 | 5.5 |
| H | 32.7 | 5.6 | 33.0 | 5.5 | 30.6 | 5.5 |
| I | 63.0 | 1.1 | 61.4 | 1.1 | 59.3 | 1.1 |
| J | 24.6 | 1.3 | 24.9 | 1.3 | 24.2 | 1.3 |
| K | 0.5 | 1.0 | 0.6 | 1.0 | 0.6 | 1.0 |
| L | 30.6 | 1.4 | 20.4 | 1.4 | 10.3 | 1.4 |
| M | −10.0 | 1.4 | 0.2 | 1.4 | 10.2 | 1.4 |
| N | 5.6 | 5.3 | 5.6 | 5.2 | 5.6 | 5.2 |
| O | 0 | 5.3 | 11.7 | 5.3 | 24.1 | 5.3 |

N.B.
Negative sign indicates liquid flow from storage to plant.

It should be noted that instead of storing liquid nitrogen it would be possible to store liquid air or crude liquid oxygen.

It should also be noted that the plant could be operated with constant gaseous oxygen production and variable air flow to take advantage of low power tariffs at night. However, rapid change in the air flow cannot be made.

In summary, in both the embodiments shown, at constant air feed, flow through the expander is reduced to give increased GOX production and flow through the expander increased to give decreased GOX production. Similarly, if the flow of feed air is decreased the same GOX production can be maintained by reducing the flow through the expander.

I claim:

1. A plant for producing gaseous oxygen which comprises a means for rapidly varying the production rate of gaseous oxygen with minimal upset of distillation column operating conditions and minimal loss of product quality wherein said plant comprises a heat exchanger for cooling feed air, a double distillation column having a high pressure column for receiving at least part of said feed air, and a low pressure column, a liquid oxygen (LOX) storage vessel communicating with said low pressure column, means to bring liquid oxygen from said LOX storage vessel into heat exchange with vapour from said high pressure column to provide reflux for said high pressure column, and a liquid storage vessel communicating with said high pressure column, and means to return liquid from said liquid storage vessel to said column as reflux, characterized in that said plant further comprises an expander arranged to expand vapour from said high pressure column and pass the expanded vapour through said heat exchanger and further characterized in that said plant comprises means to control the flow of vapour through said expander.

2. A plant according to claim 1, characterised in that the expander is arranged to expand nitrogen from the top of said high pressure column.

3. A plant according to claim 2, characterised in that said liquid storage vessel is arranged to receive liquid nitrogen.

4. A plant according to claim 1 characterised in that said liquid storage vessel is arranged to receive liquid nitrogen.

* * * * *